US005431337A

United States Patent [19]

Bell

[11] Patent Number: 5,431,337

[45] Date of Patent: Jul. 11, 1995

[54] REPLY MAIL ENVELOPE

[75] Inventor: Leslie J. Bell, 1842 Manhassett Ave., Almonesson, N.J. 08096

[73] Assignees: Leslie J. Bell, Almonesson, N.J.; Avante Garde Enterprises Ltd., Philadelphia, Pa.

[21] Appl. No.: 272,313

[22] Filed: Jul. 8, 1994

[51] Int. Cl.[6] ..... B65D 27/06

[52] U.S. Cl. ..... 229/305; 229/69; 229/306; 229/316

[58] Field of Search ..... 229/302, 305, 306, 316, 229/69

[56] References Cited

U.S. PATENT DOCUMENTS

| | | | |
|---|---|---|---|
| 3,552,641 | 1/1971 | Bell . | |
| 4,382,539 | 5/1983 | Kronman | 229/302 |
| 4,565,317 | 1/1986 | Kranz . | |
| 4,586,611 | 5/1986 | Scalzo | 229/316 |
| 4,602,736 | 7/1986 | Barr . | |
| 4,669,652 | 6/1987 | Sequin . | |
| 4,715,531 | 12/1987 | Stewart et al. . | |
| 4,756,468 | 7/1988 | Jenkins . | |
| 4,896,823 | 1/1990 | Taylor . | |
| 5,197,663 | 3/1993 | Stude . | |
| 5,253,803 | 10/1993 | Chess | 229/303 |
| 5,292,062 | 3/1994 | Chess . | |

*Primary Examiner*—Allan N. Shoap

*Assistant Examiner*—Jes F. Pascua

*Attorney, Agent, or Firm*—Richard C. Litman

[57] ABSTRACT

A reply mail envelope to facilitate both as an outgoing and reply mailer. A front ply is affixed to a back ply so as to form a sealed envelope. Lines of perforations in each ply define an end portion of the envelope which is removable. The perforation lines in the front ply are offset relative to those in the back ply to provide an exposed marginal portion of the back ply. A return address flap loosely disposed intermediate the front and back plies has a first side edge affixed to the exposed marginal portion of the back ply. An insert is interposed between the front ply and the reply address flap. A second side edge of the return address flap opposite the first side edge is releasably attached to an undersurface of the insert. Upon removal of the removable end portion of the envelope, the insert is exposed so as to be easily grasped by a recipient. Upon removal of the insert from the envelope, the reply address flap releasably attached thereto follows. A continual displacement of the insert causes the reply address flap to separate from the insert and to return to a position covering a portion of the front ply, in turn, overlapping the initial outgoing address while exposing the reply address. A plurality of these envelopes may be detachable connected together forming a continuous series of envelopes which may be rapidly and successively prepared for mailing.

20 Claims, 3 Drawing Sheets

REPLY MAIL ENVELOPE

BACKGROUND OF THE INVENTION

1. Field of the Invention

The present invention relates generally to envelopes, and more particularly to remailing envelopes structured to conceal at least part of an original outgoing mailing when remailed.

2. Description of the Prior Art

Mailers often include envelopes for use in mailing replies. Enclosing reply envelopes can be costly with respect to excess material consumption, surplus weight, additional postage, and added time in assembling and stuffing envelopes.

Usage of envelopes constructed to serve both as an outgoing and reply mailers is advantageous in distributing information that may require remittance. To this end, remailer envelopes have been constructed with a ply having an outgoing address printed thereon and which forms a cover that extends over at least a portion of the front of the envelope to cover an underlying reply address. The cover is removable to expose the reply address. Conversely, envelopes are constructed with a front having an initial outgoing address printed thereon and a cover that is extendable over at least a portion of the front of the envelope to cover the outgoing address and expose a reply address.

Remailing envelopes are known. For example, U.S. Pat. No. 4,565,317, issued Jan. 21, 1986 to Richard Kranz, discloses a two-way envelope including a front panel with a window opening, and a back panel connected to the front panel. An initial seal flap extends from an upper edge of the front panel and is demarcated therefrom by a perforated tear line. A return flap extends from an upper edge of the back panel and is demarcated therefrom by a fold line. An extension having a return address thereon is integrally connected to the return flap along an extension fold line. The return flap and the extension are folded with respect to each other and placed within a pocket formed by the envelope for an initial mailing. For return mailing, the return flap and the extension are placed over the front panel with the extension covering the window opening.

Another two-way mailing envelope is disclosed in U.S. Pat. No. 4,602,736, issued Jul. 29, 1986 to Arthur C. Barr. This two-way mailing envelope is formed from a single blank having rectangular front and rear panels joined together along an upper fold line, and first and second closure flaps joined to the lower edges of the front and rear panels, respectively, along the lower fold lines. Mailing address indicia are provided on the front side of the envelope in a mailing address read area and a return address is provided on the front side of the envelope at level above the mailing address. During an initial mailing, the first flap is folded upwardly and sealed to the rear panel. During a re-mailing, the envelope is resealed by folding the second flap upwardly and sealing the same against the front panel so as to cover the original mailing address while leaving the return address exposed.

U.S. Pat. No. 4,669,652, issued Jun. 2, 1987 to Sylvain Sequin, discloses yet another two-way mailing envelope. The envelope disclosed by Sequin comprises a pair of panels foldably connected along one fold line extending along a bottom edge and folded over one another to form an envelope. A closure flap is foldably connected to one panel and foldable over the other panel to seal a first mailing envelope. The first mailing envelope is converted to a return mailing envelope by tearing off three edges of the mailing envelope and folding the envelope inside out. A second closure flap is provided for sealing the return mailing envelope. A configuration similar to that disclosed by Sequin above is disclosed in U.S. Pat. No. 4,715,531, issued Dec. 29, 1987 to Russell M. Stewart et al.

A mailer including a cover sheet attached to a return address mailer is disclosed in U.S. Pat. No. 4,756,468, issued Jul. 12, 1988 to Richard A. Jenkins. The cover sheet has an integral remittance document and a window through which an initial mail-to address label is visible. The cover sheet is separable from the return address mailer to expose the return mail-to address and the remittance document is detachable from the cover sheet for placement in the return address mailer.

U.S. Pat. No. 5,197,663, issued Mar. 30, 1993 to Michael Stude, discloses a reusable mailing envelope including a front panel, a seal flap, a rear panel opposite the seal flap, and first and second side panels, connected by fold lines. A reusable structure is connected to the rear panel along yet another fold line, including a foldable panel and a reusable closure flap which permit the envelope to be reused as a mailing envelope.

A return mailer is disclosed in U.S. Pat. No. 5,292,062, issued Mar. 8, 1994 to Stanley C. Chess. The return mailer may be converted from an outgoing mailer to a reply mailer. The mailer includes a number of plies including a first ply having an outgoing address visible thereon, at least one insert ply, a second ply, and a third ply. A sealing agent is associated with one of the plies for sealing the plies of the reply configuration. The first ply has an outgoing address printed thereon and the second ply has a reply address printed thereon. The second ply is pivotally mounted to fold over the first ply so as to permit the reply address to be visible and render the outgoing mailing address invisible. The third ply cooperates with the sealing agent to form a reply envelope.

A continuous web of remailing envelopes which permit a rapid succession of envelopes to be prepared for mailing to an outgoing address is advantageous in preparing and distributing mass quantities of reply mail. Continuous webs of remailing envelopes are known. For example, U.S. Pat. No. 3,552,641, issued Jan. 5, 1971 to Leslie J. Bell et al., discloses a continuous envelope assembly including a plurality of individual envelopes interconnected and separable along a perforation line. Each envelope includes a top ply, a bottom ply secured to the top ply by means of adhesive around the periphery thereof, and an insert material housed freely between the top and bottom plies. The top and bottom plies each have control punching connected to an end thereof by a line of perforations. No adhesive is provided adjacent the control punching and the top and bottom plies. A line of perforations is provided in the top ply and a line of perforations is provided in the bottom ply spaced inwardly from an edge. The perforations cooperate with an end of the envelope to define an end portion and are provided to facilitate in the removal of the end portion to permit access to the insert material. The insert material includes a return address envelope and may include an information sheet. The envelope is provided with a projecting tab having pressure sensitive adhesive thereon and a cover strip on the pressure sensitive adhesive.

Another continuous feed mailer is disclosed in U.S. Pat. No. 4,896,823, issued Jan. 30, 1990 to James C. Taylor. Taylor discloses a C-fold mailer including first, second, and third panels foldable about transversely extending fold lines to form a mailer with a return envelope. The second and third panels are folded together and adhesively secured along three margins and the first panel is adhesively secured along the outside face of the third panel. When folded properly, address information provided on the face of the third panel appears for display through a die-cut window in the second panel. Perforations in the first panel define a detachable panel portion which may comprise a remittance slip and a stub. The remittance slip may be inserted into the return envelope and a flap may be provided which is foldable to seal the remittance slip within therein. The mailer is further provided with marginal feed strips having tractor feed openings so as to permit a continuous web of mailers may be fed automatically.

None of the above patents, taken either singly or in combination, is seen to describe the instant invention as claimed.

SUMMARY OF THE INVENTION

The present invention is related to a reply mail envelope to facilitate both as an outgoing and reply mailer for use in distributing information that may require remittance. The envelope basically comprises a front ply affixed to a back ply. A line of perforations is provided in each of the plies a predetermined distance from a side edge thereof so as to define a removable end portion. The line of perforations in the front panel is offset relative to the line of perforations in the back ply so as to provide a marginal portion of the back ply therebetween.

A return address flap is loosely disposed intermediate the front and back plies and an insert is interposed between the front ply and the reply address flap. A first side edge of the return address flap is affixed to the marginal portion of the back ply. A second side edge of the return address flap opposite the first side edge thereof is releasably attached to a lower surface of the insert.

Upon removal of the removable end portion of the envelope, a first side edge of the insert is exposed so as to be easily grasped by a recipient. Upon removal of the insert from the envelope, the reply address flap follows. A continual displacement of the insert causes the reply address flap to separate from the insert. Upon separation of the insert from the reply address flap, the reply address flap returns to a position covering at least a portion of the front ply.

The front ply may include an outgoing address, a return address, and postage. The reply address flap may include a reply address and postage. Instructions advising the recipient as to the use of the envelope may also be provided on the envelope. Upon removal of the insert the reply address flap returns to a position overlapping at least a portion of the original outgoing address and exposing the reply address.

A plurality of these envelopes may be detachably connected to one another so as to form a continuous feed stock which permits a series of envelopes to be rapidly and successively prepared for mailing.

Several advantages are offered through applicant's instant invention. For example, less paper is consumed. Typically three to four plies are required to produce an outgoing envelope and a reply envelope or a combination of the same. According to applicant's instant invention, fewer than three full plies are required to produce both an outgoing and a reply mail envelope combined. This decrease in paper consumption not only renders a savings in material costs but has a positive impact on the environment as a whole, requiring less consumption of our natural resources and a reduction in waste management.

Another advantage is centered around the ease within which applicant's instant invention may be used. By merely pulling on opposite side edges of the envelope, an end portion of the envelope is removed with the envelope contents, that is, the insert. The envelope is configured to permit easy removal of the insert. The reply address flap follows the insert as the insert is being removed. A further displacement of the insert separates the insert from the reply address flap which, in turn, naturally returns to a location covering at least a portion of the front ply and overlapping at least a portion of the original outgoing address while at the same time, exposing the reply address. Only one step is required removing of the end portion of the envelope and simultaneously removing of the insert and overlapping the outgoing address with a reply address.

Accordingly, it is a principal object of the invention to provide a reply mail envelope which facilitates both as an outgoing mailer and reply mailer for use in distributing information that may require remittance.

Another object is that the envelope basically comprise a front ply affixed to a back ply and a return address flap and insert interposed between the front and back plies, whereupon a removal of a removable end portion of the envelope exposes the insert, and a removal of the insert, in turn, causes the reply address flap to follow and separate from the insert and cover at least a portion of the front ply.

It is another object to provide a plurality of envelopes detachably connected to one another so as to form a continuous feed stock which permits a series of envelopes to be rapidly and successively prepared for mailing.

It is a further object to provide a remailer envelope which requires less paper consumption and thereby renders a savings in material costs and produces a positive impact on the environment.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
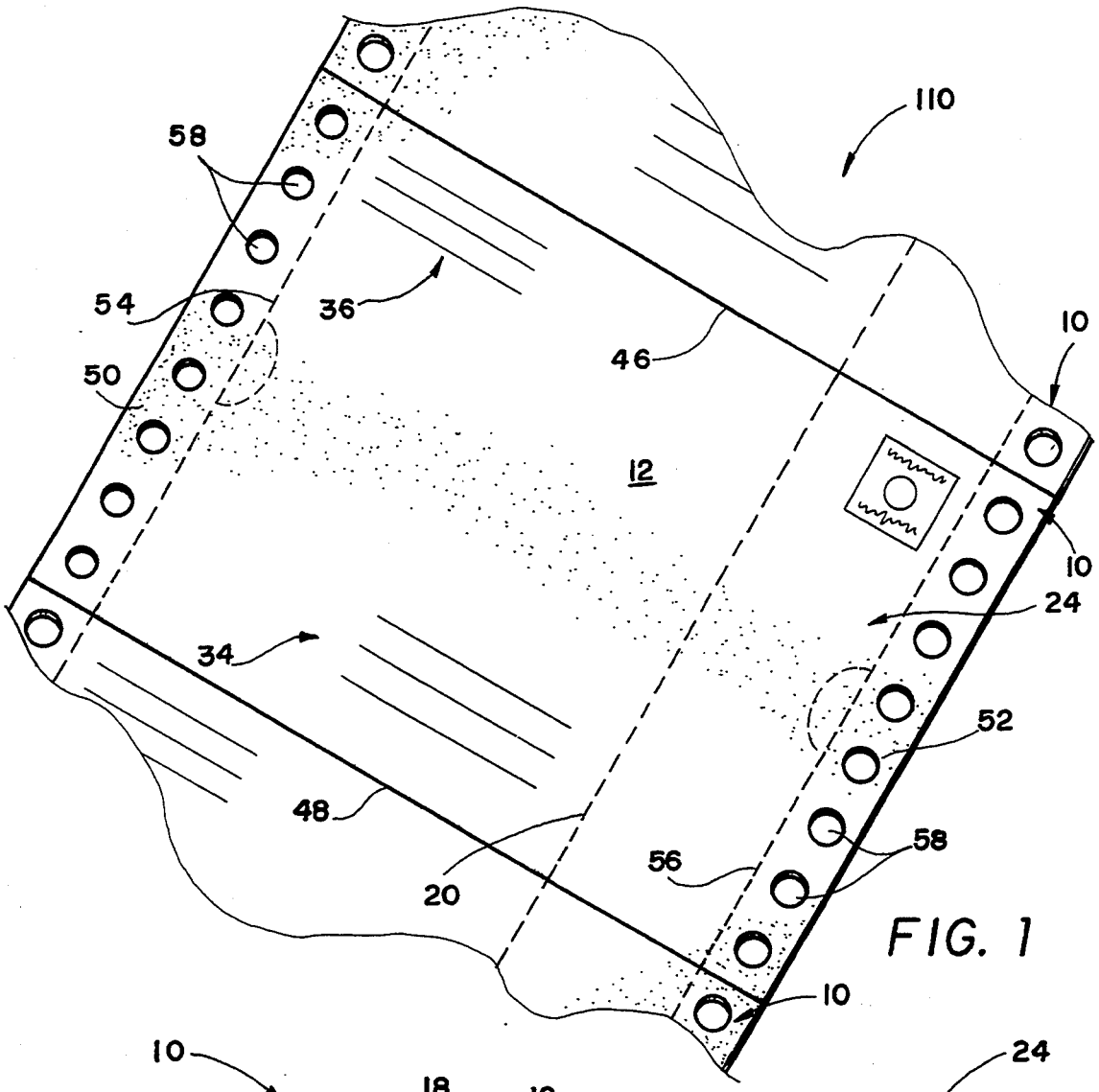
FIG. 1 is front perspective view of a remailer envelope according to the present invention.
Figure 2:
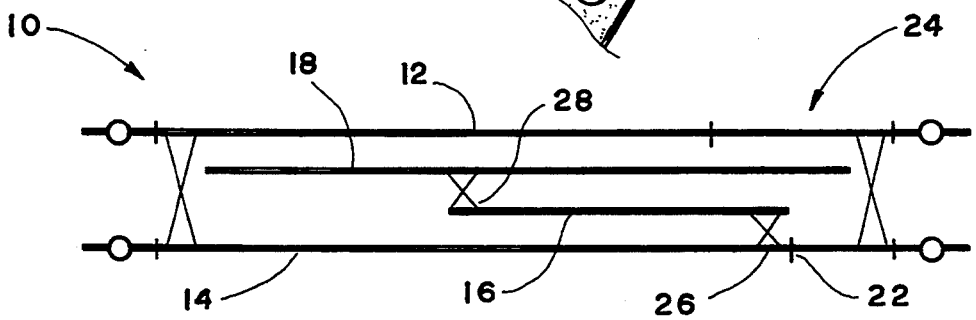
FIG. 2 is a diagrammatic representation of the remailer shown in FIG. 1 shown largely in section.

The present invention, as shown in FIGS. 1 and 2, is a reply mail envelope 10 structured and configured to function both as an outgoing mailer and reply mailer for use in distributing information that may request or require remittance. The reply mail envelope 10 basically comprises a front ply 12, a back ply 14 affixed to the front ply 12, a reply address flap 16 disposed intermediate the front and back plies 12 and 14, and an insert 18 movably interposed between the front ply 12 and the reply address flap 16. The front and back plies 12 and 14 are substantially identical in shape and size, and include mutually engageable peripheral edges. The peripheral edges of the front ply 12 are fixedly attached to corresponding peripheral edges of the back ply 14 so as to form a sealed envelope 10.

The front ply 12 is provided with a line of perforations 20 located predetermined distance from a first side edge thereof. Likewise, the second ply 16 is each provided with a line of perforations 22 located predetermined distance from a first side edge thereof. The first side edge of the front ply 12 corresponds to the first side edge of the second ply 14. The lines of perforations 20, 22 extend substantially the entire height of each respective ply 12, 14 defining a removable end portion 24 of the envelope 10.

The predetermined distance between the line of perforations 20 in the front ply 12 and the first side edge thereof is greater than the predetermined distance between the line of perforations 22 in the back ply 14 and the a first side edge thereof. Upon removal of the end portion 24 of the envelope 10, a marginal portion 26 of the back ply 14 defined between the lines of perforations 20, 22 in the front and back plies 12 and 14 is provided.

Figure 3:
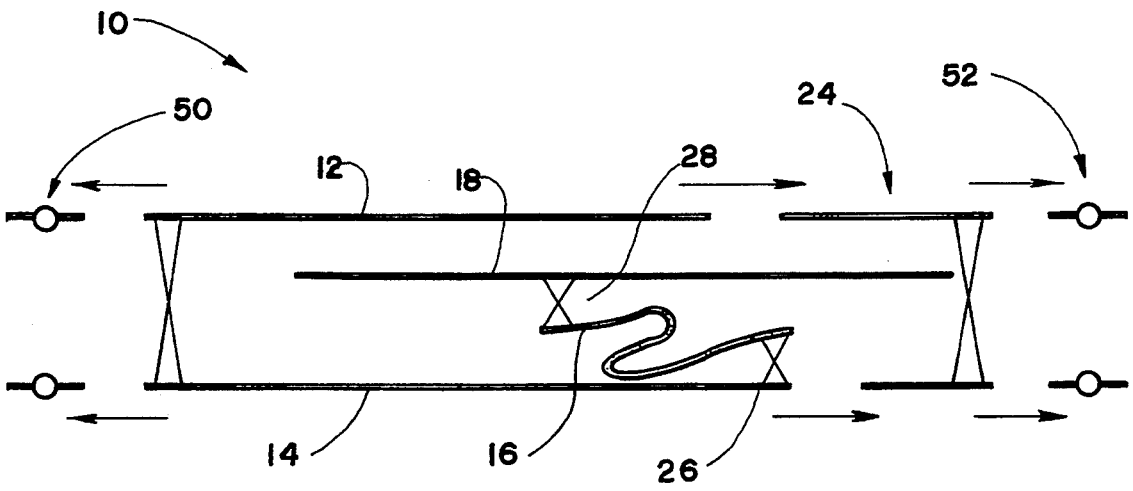
FIG. 3 is a diagrammatic representation of the remailer shown in FIG. 2 with marginal strips removed, an end portion of the envelope removed, and an insert within the envelope partially removed.

The reply address flap 16 is dimensioned to fit loosely within the envelope 10. A lower surface of a first side edge of the reply address flap 16 is affixed to the exposed marginal portion 26 of the back ply 14, as is shown in FIG. 3. The remainder of the reply address flap 16 is permitted to move freely within the envelope 10.

The insert 18 fits loosely within envelope 10 and slightly extends beyond the marginal portion 26 of the back ply 14 so as to be permitted to be easily grasped between the fingers of a recipient upon the removal of the end portion 24 of the envelope 10. A second side edge of the reply address flap 16 opposite the first side edge thereof has an upper surface which is releasably attached to a lower surface of the insert 18, such as by a tacky adhesive 28.

Figure 4:
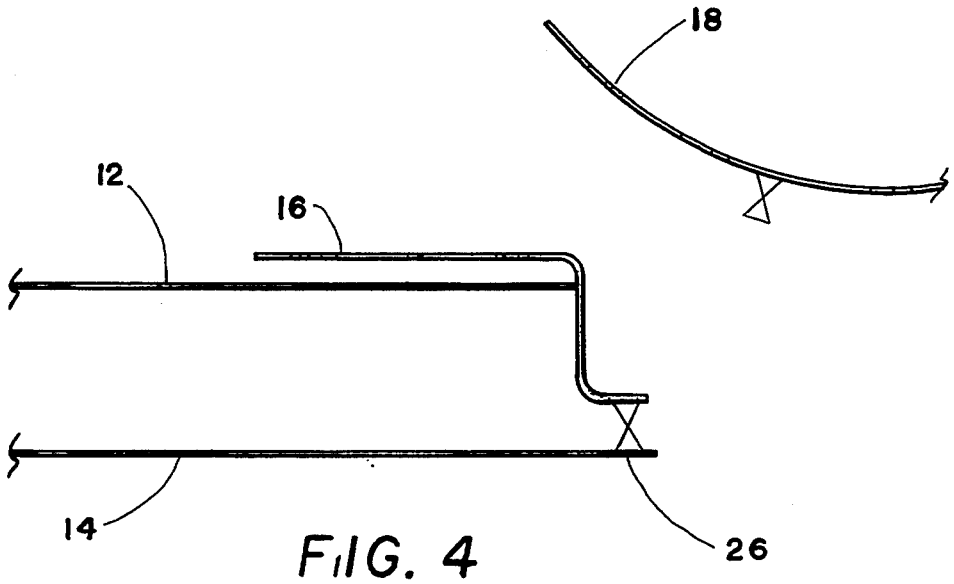
FIG. 4 is a partial diagrammatic representation of the remailer shown in FIG. 2 with the insert and the reply address flap removed from the envelope and the reply address flap further returned to a position covering a front ply of the envelope.

Upon removal of the insert 18 from the envelope 10, as is shown in FIG. 3, the reply address flap 16 follows. A continued displacement of the insert 18 relative to the envelope 10 causes the insert 18 to separate from the return address flap 16, enabling the return address flap 16 to naturally return to a position covering a portion of the front ply 12, as is shown in FIG. 4.

Figure 5:
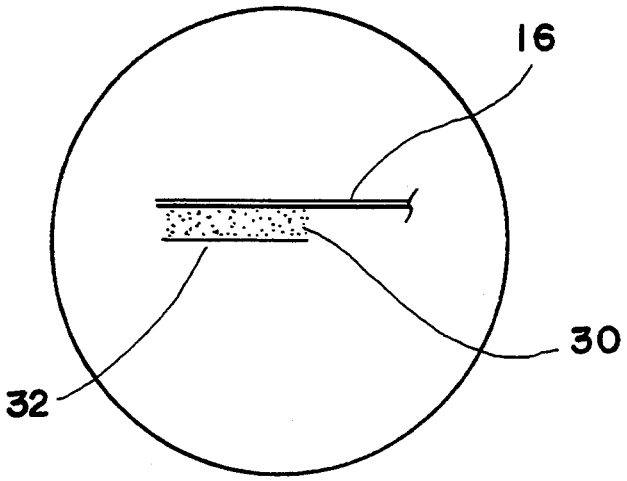
FIG. 5 is an enlarged elevational view of an end of the reply address flap having adhesive provided on a lower surface thereof.
Figure 6:
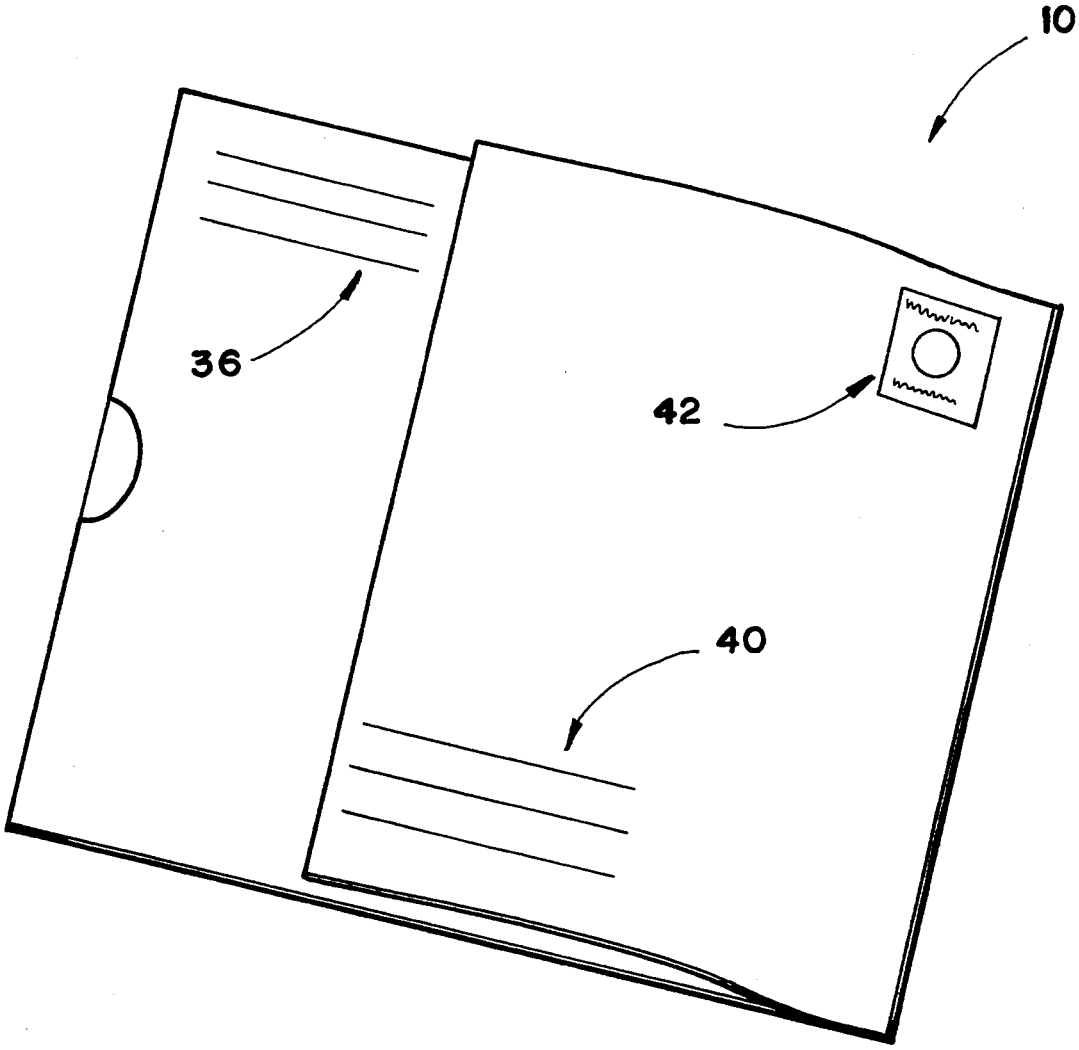
FIG. 6 is a front perspective view of the envelope with the reply address flap covering a front ply of the envelope and overlapping an outgoing address while exposing a reply address.

A second side edge of the reply address flap 16 opposite the first side edge has adhesive on an underside thereof, such as the adhesive 30 protected by the release sheet 32 shown in FIG. 5. The adhesive 30 is provided for sealing the reply address flap 16 to the front ply 12, as is shown in FIG. 6.

Indicia is preferably provided in designated locations on the front ply 12. For example, the front ply 12 may be provided with a first surface area 34 for displaying an original or outgoing mailing address, a second surface area 36 for displaying a return address, and a third surface area 38 for displaying postage. The mailing address, the postage, or both may be preprinted in the respective and designated locations.

Indicia is also preferably provided in designated locations on the reply address flap 16. The reply address flap 16 may be provided a first surface area 40 for displaying a reply mailing address and a second surface area 42 for displaying postage. Similar to that of the indicia provided on the front ply 12, the indicia provided on the reply address flap 16 may be preprinted. As shown in FIG. 4, the return address flap 16 overlaps the initial outgoing address 12 and displays the reply address 14.

The insert 18 may also be provided with indicia. This indicia may be in the form of information and/or a remittance slip. A remittance slip may be inserted back into the envelope 10 and the envelope 10 may be sealed by the reply address flap 16.

Referring back to FIG. 1, it should be noted that a plurality of envelopes 10 may be interconnected to one another along lines of perforations 46, 48 along the top and bottom edges of each envelope to form a continuous series of envelopes 110. The continuous series of envelopes 110 may be provided with detachable marginal strips 50, 52 along opposite side edges thereof. The marginal strips 50, 52 are detachable along lines of perforations 54, 56 along the opposite side edges. The marginal strips 50, 52 may include means for engaging a continuous feed mechanism, such as the pin feed holes 58 shown. This continuous feed stock 110 permits a series of envelopes 10 to be rapidly and successively prepared for mailing.

It is to be understood that the present invention is not limited to the sole embodiment described above, but encompasses any and all embodiments within the scope of the following claims.

I claim:

1. A reply mail envelope comprising:

a front ply having a line of perforations therein, a back ply having a line of perforations therein, said back ply being affixed to said front ply, said line of perforations in said back ply being parallel to and spaced from said line of perforations in said front ply so as to provide a marginal portion of said back ply therebetween, said lines of perforations defining a removable end portion of said envelope, a reply address flap having a first side edge and a second side edge opposite said first side edge, said first side edge being affixed to said marginal portion of said back ply, said reply address flap further being disposed intermediate said front and back plies, and an insert interposed between said front ply and said reply address flap, said insert being releasably attached to said second side edge of said reply address flap.

2. The envelope according to claim 1, wherein said front and back plies are substantially identical in shape and in dimension and each include a plurality of peripheral edges, each one of said plurality of peripheral edges of said front ply being mutually engageable with and affixed to a respective one of said plurality of peripheral edges of said back ply.

3. The envelope according to claim 1, wherein said front and back plies further include at least a first side edge, said line of perforations in said front ply being located a predetermined distance from said first side edge of said front ply and said line of perforations in said back ply being located a predetermined distance from said first side edge of said back ply, the predetermined distance between said first side edge of said front ply and said line of perforations in said front ply being greater than the predetermined distance between said first side edge of said back ply and said line of perforations in said back ply.

4. The envelope according to claim 1, wherein said front and back plies each include top and bottom edges and wherein lines of perforations in said front and back plies extend substantially from said top and bottom edges of said front and back plies, respectively.

5. The envelope according to claim 1, wherein said reply address flap and said insert are each dimensioned and configured to fit loosely between said front and back plies.

6. The envelope according to claim 1, wherein said insert in dimensioned and configured to extend beyond said marginal portion of said back ply and within said removable end portion of said envelope.

7. The envelope according to claim 1, wherein said reply address flap further includes an upper surface, a lower surface, and means for sealing said reply address flap located on said lower surface of said second side edge thereof, and wherein said insert further includes a lower surface, said upper surface of said second side edge of said reply address flap being releasably attached to said lower surface of said insert.

8. The envelope according to claim 7, wherein said adhesive means includes adhesive located on said lower surface of said second side edge of said reply address flap and a protective release sheet covering said adhesive.

9. The envelope according to claim 1, wherein said front ply includes a first surface area for displaying an outgoing mailing address, a second surface area for displaying a return mailing address, and a third mailing address for displaying outgoing postage, and wherein said reply address flap includes a first surface area for displaying a reply mailing address and a second surface area for displaying return postage.

10. The envelope according to claim 1, wherein said envelope includes an exterior portion carrying indicia in the form of opening instructions, wherein said exterior portion carrying indicia does not overlap said insert.

11. A reply mail envelope comprising:

a front ply having a plurality of peripheral edges including at least a first side edge, said front ply further having a line of perforations therein, said line of perforations being located a predetermined distance from said first side edge of said front ply, a back ply having a plurality of peripheral edges including at least a first side edge, said back ply further having a line of perforations therein, said line of perforations in said back ply being located a predetermined distance from said first side edge of said back ply, said first side edge of said back ply corresponding to said first side edge of said front ply, said plurality of said peripheral edges of said back ply being affixed to said plurality of said peripheral edges of said front ply, said line of perforations in said back ply further being parallel to and spaced from said line of perforations in said front ply so as to provide a marginal portion of said back ply therebetween, said lines of perforations defining a removable end portion of said envelope, a reply address flap having a first side edge and a second side edge opposite said first side edge thereof, said reply address flap being disposed intermediate said front and back plies, said first side edge of said reply address flap being affixed to said marginal portion of said back ply, and an insert interposed between said front ply and said reply address flap, said insert being releasably attached to said second side edge of said reply address flap.

12. The envelope according to claim 11, wherein said front and back plies each include top and bottom edges and wherein lines of perforations in said front and back plies extend substantially from said top and bottom edges of said front and back plies, respectively.

13. The envelope according to claim 11, wherein said insert in dimensioned and configured to extend beyond said marginal portion of said back ply and within said removable end portion of said envelope.

14. The envelope according to claim 11, wherein said reply address flap further includes an upper surface, a lower surface, and means for sealing said reply address flap located on said lower surface of said second side edge thereof, and wherein said insert further includes a lower surface, said upper surface of said second side edge of said reply address flap being releasably attached to said lower surface of said insert.

15. The envelope according to claim 14, wherein said adhesive means includes adhesive located on said lower surface of said second side edge of said reply address flap and a protective release sheet covering said adhesive.

16. A continuous series of reply mail envelopes comprising:

a plurality of envelopes, said envelopes being detachably interconnected, said envelopes including:

a front ply having a line of perforations therein, a back ply having a line of perforations therein, said back ply being affixed to said front ply, said line of perforations in said back ply being parallel to and spaced from said line of perforations in said front ply so as to provide a marginal portion of said back ply therebetween, said lines of perforations defining a removable end portion, a reply address flap having a first side edge and a second side edge opposite said first side edge thereof, said reply address flap being disposed intermediate said front and back plies, said first side edge being affixed to said marginal portion of said back ply, and an insert interposed between said front ply and said reply address flap, said insert being releasably attached to said second side edge of said reply address flap.

17. The envelope according to claim 16, wherein said front and back plies each include top and bottom edges and wherein lines of perforations in said front and back plies extend substantially from said top and bottom edges of said front and back plies, respectively.

18. The envelope according to claim 16, wherein said insert in dimensioned and configured to extend beyond said marginal portion of said back ply and within said removable end portion of said envelope.

19. The envelope according to claim 16, wherein said reply address flap further includes an upper surface, a lower surface, and means for sealing said reply address flap located on said lower surface of said second side edge thereof, and wherein said insert further includes a lower surface, said upper surface of said second side edge of said reply address flap being releasably attached to said lower surface of said insert.

20. The envelope according to claim 19, wherein said adhesive means includes adhesive located on said lower surface of said second side edge of said reply address flap and a protective release sheet covering said adhesive.

* * * * *